US006446971B1

(12) United States Patent
Baranauskas

(10) Patent No.: US 6,446,971 B1
(45) Date of Patent: Sep. 10, 2002

(54) METHOD AND APPARATUS FOR PLAYING A WAGERING GAME

(76) Inventor: Alfons V. Baranauskas, 9956 Johnny Cake Rd., Unit M-10, Concord, OH (US) 44077

( * ) Notice: Subject to any disclaimer, the term of this patent is extended or adjusted under 35 U.S.C. 154(b) by 0 days.

(21) Appl. No.: 09/522,051

(22) Filed: Mar. 9, 2000

Related U.S. Application Data

(60) Provisional application No. 60/123,462, filed on Mar. 9, 1999, provisional application No. 60/123,460, filed on Mar. 9, 1999, provisional application No. 60/123,478, filed on Mar. 9, 1999, provisional application No. 60/123,466, filed on Mar. 9, 1999, provisional application No. 60/131,032, filed on Apr. 26, 1999, and provisional application No. 60/123,467, filed on Mar. 9, 1999.

(51) Int. Cl.[7] ..... A63F 1/00

(52) U.S. Cl. ..... 273/292; 273/294

(58) Field of Search ..... 273/292, 236, 273/274, 138.1; 463/16, 17

(56) References Cited

U.S. PATENT DOCUMENTS

| | | | | |
|---|---|---|---|---|
| 3,667,757 A | | 6/1972 | Holmberg | |
| 4,817,528 A | | 4/1989 | Baker | |
| 5,072,946 A | * | 12/1991 | Miller | 273/292 |
| 5,098,107 A | | 3/1992 | Boylan et al. | |
| 5,112,059 A | | 5/1992 | Mundle et al. | |
| 5,174,579 A | * | 12/1992 | Griffighs | 273/292 |
| 5,226,661 A | * | 7/1993 | Wolf | 273/274 |
| 5,288,081 A | | 2/1994 | Breeding | |
| 5,314,193 A | * | 5/1994 | Ferrer | 273/292 |
| 5,324,041 A | | 6/1994 | Boylann et al. | |
| 5,417,430 A | | 5/1995 | Breeding | |
| 5,431,407 A | | 7/1995 | Hofbergn et al. | |
| 5,437,462 A | | 8/1995 | Breeding | |

(List continued on next page.)

OTHER PUBLICATIONS

Alfons V. Baranauskas; Triptease; Mar. 9, 1998 (effective date of copyright, registration); TXu 843–395.

Alfons V. Baranauskas; Forty–Niner; Mar. 9, 1998 (effective date of copyright registration); TXu 843–393.

Alfons V. Baranauskas; Wagering Card Game; Mar. 9, 1998 (effective date of copyright registration); TXu 843–411.

Alfons V. Baranauskas; On The Money; Mar. 9, 1998 (effective date of copyright registration); TXu 848–200.

Alfons V. Baranauskas; Birdie; Mar. 9, 1998 (effective date of copyright registration); TXu 843–394.

Alfons V. Baranauskas; Trio; Jul. 15, 1999 (date received by Copyright Office).

Alfons V. Baranauskas; Match; Jul. 15, 1999 (date received by Copyright Office).

Alfons V. Baranauskas; Midway; Jul. 15, 1999 (date received by Copyright Office).

Alfons V. Baranauskas; Split; Jul. 15, 1999 (date received by Copyright Office).

Alfons V. Baranauskas; Niner; Jul. 15, 1999 (date received by Copyright Office).

*Primary Examiner*—Valencia Martin-Wallace
*Assistant Examiner*—Alex R. P. Rada, II
(74) *Attorney, Agent, or Firm*—Renner, Otto, Boisselle & Sklar, LLP

(57) ABSTRACT

A playing card wagering game method which includes each player placing an initial wager. Cards are dealt by a dealer, one card face down to the dealer, one card face down to each player and one card face up to the dealer. Players view their card then decide to either surrender their hand or to place an additional amount to their initial wager. Players can draw up to two additional cards at no additional wager cost, or players can pay an additional amount for each the cards not drawn. Dealer draws the third card for the dealers three card hand. Finally the dealer reveals the players and dealers cards and resolves all players bets which were not withdrawn based on that players one, two or three card hands value. Winning players hands must straddle to either side the value of the dealers three card hand.

37 Claims, 7 Drawing Sheets

U.S. PATENT DOCUMENTS 5,454,570 A 10/1995 Karal
5,496,038 A 3/1996 Kangsanaraks
5,529,309 A 6/1996 Bartlett
5,544,892 A 8/1996 Breeding
5,549,300 A 8/1996 Sardarian
5,713,573 A 2/1998 Nazaryan
5,713,574 A * 2/1998 Hughes ..... 273/292
5,720,484 A 2/1998 Hsu
5,743,530 A 4/1998 Sklad et al.
5,762,340 A 6/1998 Feola
5,772,211 A 6/1998 Nazaryan et al.
5,794,934 A 8/1998 Malcolm
5,803,809 A 9/1998 Yoscloff
5,813,673 A 9/1998 Richardson
5,845,906 A 12/1998 Wirth
5,845,907 A 12/1998 Wells
5,851,011 A 12/1998 Lott
5,895,047 A 4/1999 Callahan
5,911,419 A 6/1999 Dalaney et al.
5,957,459 A 9/1999 Chae
5,975,529 A 11/1999 de Keller
5,988,643 A 11/1999 Awada
6,019,374 A 2/2000 Breeding
6,029,976 A 2/2000 Brunelle
6,042,118 A 3/2000 Poitra
6,065,753 A * 5/2000 Morosky ..... 273/292
6,070,873 A 6/2000 Perkins
6,073,930 A 6/2000 Jones et al.
6,079,713 A 6/2000 Paz
6,095,525 A 8/2000 Terminel
6,098,984 A 8/2000 Moore, Jr.
6,113,101 A 9/2000 Wirth
6,189,888 B1 2/2001 Brunelle
6,206,373 B1 3/2001 Garrod
6,796,548 3/2001 Schaefer
6,234,483 B1 5/2001 Bucan
6,234,485 B1 5/2001 Perkins
6,237,916 B1 5/2001 Webb
6,237,917 B1 5/2001 Timpano
6,241,250 B1 6/2001 Webb
6,247,697 B1 6/2001 Jewett
6,264,200 B1 7/2001 Smith
6,273,424 B1 8/2001 Breeding
6,279,910 B1 * 8/2001 De Keller ..... 273/292

* cited by examiner (cards not shown)

METHOD AND APPARATUS FOR PLAYING A WAGERING GAME

CLAIM OF PRIORITY

This application claims priority based on provisional patent applications Ser. No. 60/123,462, filed Mar. 9, 1999; Ser. No. 60/123,460 filed Mar. 9, 1999; Ser. No. 60/123,478, filed Mar. 9, 1999; Ser. No. 60/123,466, filed Mar. 9, 1999; Ser. No. 60/131,032, filed Apr. 26, 1999; and Ser. No. 60/123,467, filed Mar. 9, 1999. All of the aforesaid applications are hereby incorporated herein by reference.

TECHNICAL FIELD

The present invention relates to a playing card wagering game that can be played with a typical forty-eight card Pinochle playing card deck or with the higher ranking portion, said portion comprising the card ranks of Nine through Ace, of a typical fifty-two card Poker deck or conglomeration of multiple said portions, or by video machine technology in a casino or home environment. In particular, the present invention relates to a method and apparatus for playing a wagering game, wherein the game is not of Pinochle origin or set with rules for typical Pinochle play.

BACKGROUND

There are many wagering games used for betting or chancing. Such games should be entertaining to arouse players interest and uncomplicated so they can be easily understood by a large quantity of players. Ideally the game should offer more than one card drawing opportunity during the course of the game, yet be able to be played swiftly to a wager resolving outcome. Wagering card games particularly those intended for play in casinos should provide players with a sense of control and the opportunity to make more than one wagering decision and reasonable odds of winning although the odds favor the house or bank. The game must also accommodate the requirements of the regulatory agencies.

SUMMARY OF THE PRESENT INVENTION

The wagering game of the present invention may be played with the higher ranking cards or portion, said portion comprising the card ranks of Nine through Ace of a typical fifty-two card Poker deck or with a typical forty-eight card Pinochle playing card deck or with a conglomeration of multiple said decks, said cards not having a standard rank and said game does not involve the generally well recognized and accepted set of rules, procedures and hand resolving outcomes of typical Pinochle or Poker game play. The card ranks of Two through Eight need not be used in the present invention. The game method comprises of each player placing an initial wager to participate in the game. Cards are dealt by a dealer, one card is dealt to each player and two cards are dealt to the dealer or house. Next after the players view their card said players are queried by the dealer that they can continue with their one card hand or that they can surrender their one card hand. Players that choose to surrender said hand can by forfeiting part of their initial wager. Those players that chose to continue their hand now have the option of being allowed to place an additional wager, for example a double down wager, next to their initial wager. Next players can draw up to two additional cards at no additional wager amount cost. Players that choose not to draw said additional cards must pay a wager amount for each of the two said cards not drawn. After all players are content with, and/or finished drawing cards to their hands the dealer draws the third and final card for the houses hand. Dealer reveals the houses cards and totals the houses hand cards value using a method unique to the present invention comprising of converting all cards standard rank with a different whole or fractional numerical rank value. After totaling the houses hand value using the above mentioned method, the dealer verbally announces said value to the players. The dealer examines each of the players cards and resolves each players bet. Players are not playing against the dealer, house or against each other.

Preferably the dealer receives three cards as described above. However, the predetermined amount of cards constituting a final or mandatory dealer hand may be more or less than three cards as desired, for example by the house or dealer. Thus, a fourth card, or even a fifth or more cards may be dealt to the dealer. Such other predetermined amount of cards dealt to the dealer are contemplated as falling within the scope of the claimed invention.

According to an embodiment of the invention, the participating players initial wager is a one part wager and is placed before any cards are dealt by the dealer. The dealer is dealt the first card and said card is dealt face down. Next each participating player is dealt one card face down in the customary fashion and again the dealer is dealt a card, but this second house card is dealt face up. Dealer queries the players that they can continue their hand or that they can surrender their one card hand by forfeiting a portion, for example one half, of their initial wager to the house or dealer. Surrendered players hands have no further obligation and are considered dead cards, said cards and forfeited portion of said players wagers of said hands are collected by the dealer. Remaining players are now given a decision opportunity to increase their initial wager by betting an additional amount, for example an amount equal to their initial wager, and placing said amount next to said wager. Next participating players have the decision option of drawing two additional face up cards at no additional wager cost on the basis of the players hand will equal in card quantity the quantity of cards in the dealers three card hand. Players that choose not to draw their next two cards must pay an additional amount, for example an amount equal to their initial wager, for each of the said cards not drawn on the basis of said player being allowed to customize their hands value with utilizing said drawing option. Each participating player will not use their one, two or three card hand score to compete against the dealers three card hand score, but will only use dealers said three card hand score or value as a median conscious target or zone to straddle to either side of with that players one, two or three card hand score value. After the players are finished placing the additional wagers that allows that player to not draw any or all additional cards to their hands and after all other participating players have received their additional cards the dealer draws the mandatory third and final face down card for the houses three card hand. Next the dealer reveals the houses two face down cards to the players. Next the dealer examines the cards in each participating players hand. Using a method unique to the present invention, the dealer computes the houses hand value wherein said value is only a median value, then separately totals the value of each participating players hand. Said unique method comprises converting, changing or giving the card ranks of Nine through Ace each a different numerical value. For example, in an embodiment of the invention the numerical values are as follows: all court face cards as in the card ranks of King, Queen and Jack are given the value of one, all card ranks of Ace are given the value of two, all cards with the numerical rank of Ten are given the value of zero and all cards with the numerical rank of Nine are given the fractional value of half card as in 0.5 (decimal point five). Each player now has the benefit of one, two or three cards and the dealer has a mandatory total of three cards used to cause the objective median for use by each participating player. Players are trying to straddle to either side of the dealers summed three card median score with their score by a straddle value, for example one whole value, to either side of the dealers score. Thus, for example, if dealers three cards are of an Ace, Queen and a Nine card giving a total score of three and a half then winning players summed hands score would have to total four and a half or total two and a half to be considered winning hands.

In particular, the scoring objective of playing the game of the present invention is that the players are trying to end up with a total summed score that will be exactly adjacent (for example, by one numerical value, by one and a half numerical value, by a numerical value of two, or even by a fractional numerical value like 0.5) to the dealers three card median total score. In other words, the players objective is to obtain a straddle value to either side of the dealers three card median total score. Thus, if the houses three card summed score total equals two and a half, and the straddle value is one to either side of the dealer's score, then a players hand would need a total score of either one and a half or a total of three and a half to be considered a winning hand. Or, if the houses three card total score is one, and the straddle value is one to either side of the dealers score, then a players hand to be considered a winning hand score would need a total score of either zero as with having three cards with the rank of Ten or having a total score of two as in with a pair of face cards and a card rank of Ten, or as in having an Ace and two card ranks of Ten, or as in having an Ace and no additional cards drawn. All players total hands score that does not fall adjacent to the dealer median total score as in the guide line method mentioned above are considered losing hands. After the dealer examines each of the players cards said dealer determines what payout, if any, each player is entitled to receive according to that players total wager and their hands score, regarding if said score did fall or land on (i.e., straddle to) either side of the dealers summed three cards median score as in the straddling manner or method mentioned above. Payouts are made to the players with winning hands based on, for example, one for one odds or even money and the losing hands are collected. The next hand is dealt unless the cards are not sufficient in number to complete said hand, therefore the cards are reshuffled by the dealer for the next hand.

According to another embodiment of the present invention, each of the player positions includes three wagering areas.

Apparatus is disclosed for playing the wagering game according to the method outlined above. A typical gaming table with a playing surface is modified to include specific areas that provide locations for receiving the players wagers, an area for receiving and displaying the players cards, and an area for receiving and displaying the dealers cards. A card shuffling machine such as that disclosed in U.S. Pat. No. 4,807,884 for facilitating and speeding the play of the wagering may be used but is not necessary in the present invention.

It is an aim of the present invention to provide an exciting and new approach to the wagering game industry by detouring from the typical Poker game variations such as Five and Seven Card Stud or Draw Poker.

It is an aim of the present invention to provide options for easy and strategic play along with skill opportunities.

It is another aim of the present invention to provide opportunity for players to make decisions by giving said players the chance to draw or refuse to draw two additional cards, also giving said players the chance to hold or surrender their potential winning hand depending on that players strategic abilities and analyses of profitable play.

It is another aim of the present invention to provide a unique card game for play in casinos or at home and on various media including casino tables and or video machines.

It is yet another aim of the present invention to provide a new variation of two well known casino wagering games such as Baccarat and Red Dog wherein said invention combines in part both of the above mentioned games.

It is an advantage of the game of the present invention that wagering decisions, card drawing decisions along with surrender choices are inherent in the game.

Therefore the game enhances the players sense of participation and takes advantage of players inclination to change their decisions thereby providing an opportunity for the house to gain or profit due to player error.

DESCRIPTION OF THE DIAGRAMS

DETAILED DESCRIPTION OF THE PREFERRED EMBODIMENT

Figure 1:
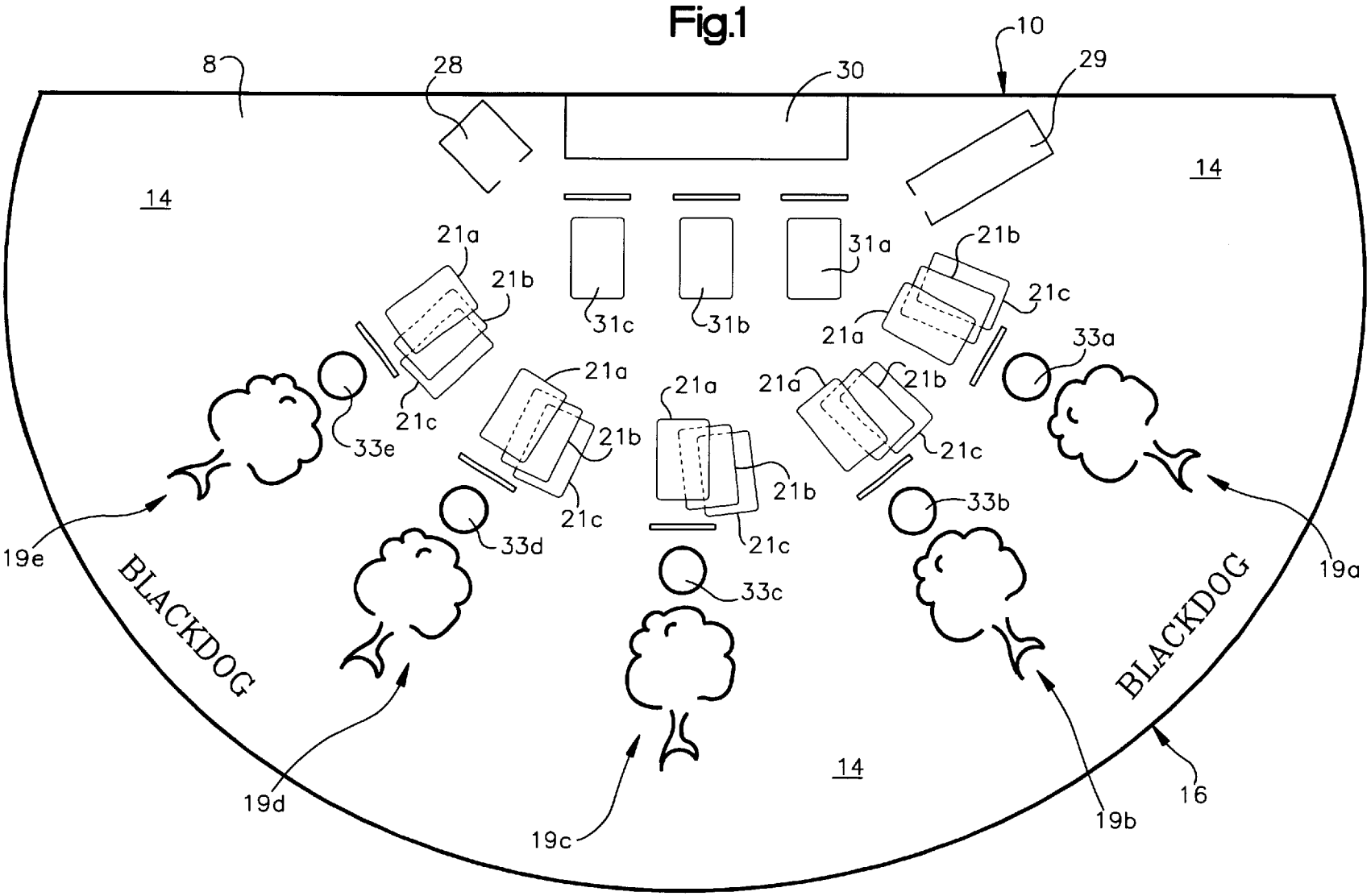
FIG. 1 depicts a table top layout and apparatus used in playing a wagering game in accordance with an embodiment of the present invention.

Referring to FIG. 1, an apparatus for the wagering game of the present invention includes a typical casino gaming, half sphere in geometric shape table 8. The table 8 has a curved side 16 for accommodating up to five players and a straight side 10 for accommodating the dealer. The table 8 has a flat surface 14 covered with cloth, felt or other appropriate material. Although five player positions or locations 19*a–e* (each being depicted by a single tree) are provided it is not essential to the game that exactly five persons play and as many as fourteen players may participate. For professional or casino play a maximum of five players provides for a game that is easily manageable by the dealer. A house dealer position 30 including an area suitable for receiving and displaying the dealers or houses cards 31*a–c* is also provided. Each of the player positions 19*a–e* includes a respective wagering area 33*a–e*. Each player position 19*a–e* also includes a card area for receiving one, two or three cards 21*a–c* dealt to the player occupying that position. The wagering areas 33*a–e* are designed to receive appropriate wagering settling means such as coins or chips (not shown). At one side of the dealer position 30 the apparatus for containing the conglomeration of hand shuffled cards rests unmounted on the table top 14 and is commonly referred to as a card shoe 29. The card shoe 29 is loaded or filled with said cards by the dealer. Said apparatus is of a typical open ended box for dispensing cards face down. At one side of the dealer position 30 is an apparatus for receiving and accumulating the used cards during game play and said may be of a raised three wall type open ended plastic box 28. Said apparatus' 8, 28 and 29 are provided by the house or casino.

Figure 2:
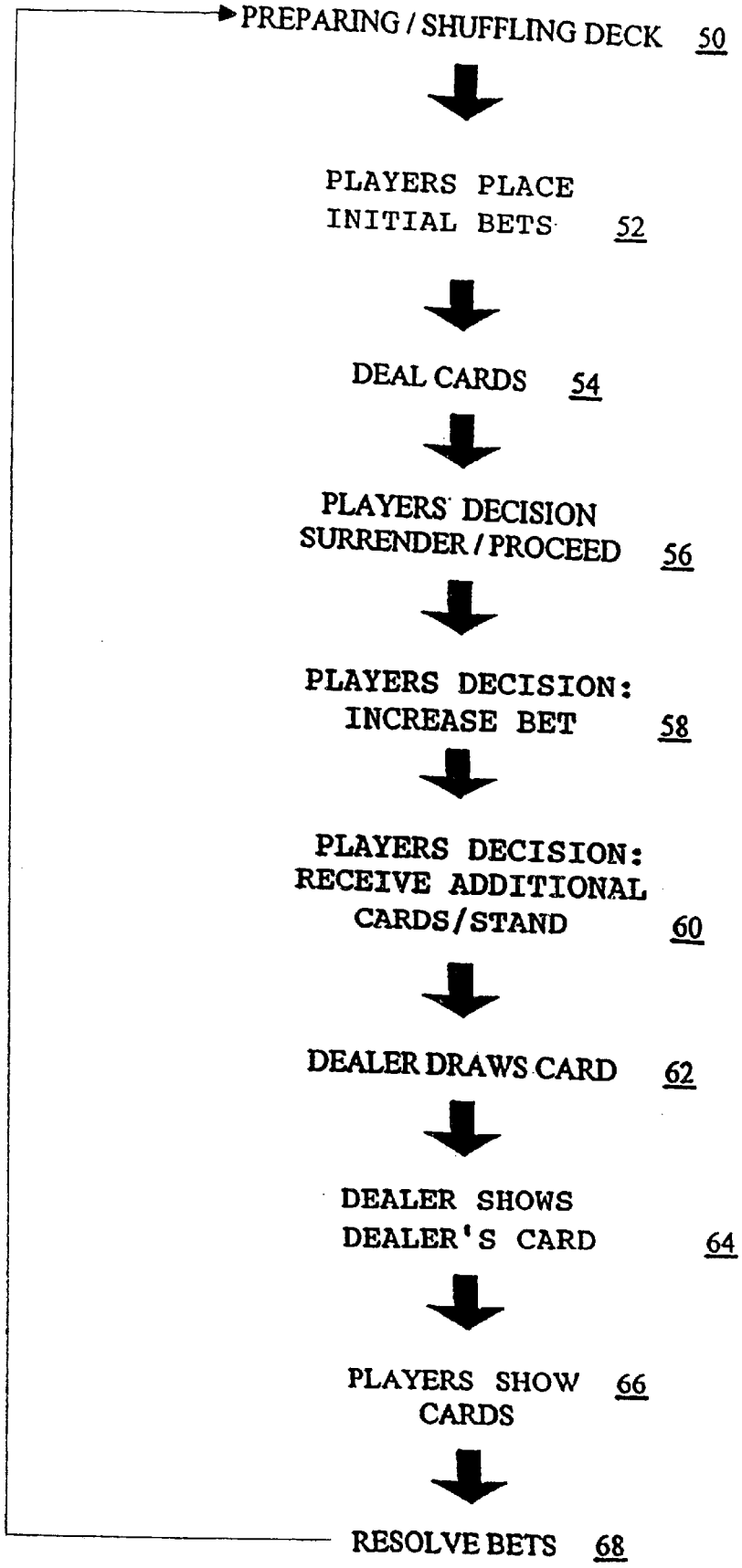
FIG. 2 is a Flow diagram representing the flow of play in said FIG. 1 game.

Referring to the Flow diagram of FIG. 2, the first step in playing the game of the present invention is preparing and shuffling the higher ranking cards or portion of a deck of Poker playing cards Flow 50. Said shuffling is done by hand and is done by the dealer. Next the participating players place their initial wager Flow 52 by placing an amount or chips into the wagering areas 33*a–e* in front of that player position 19*a–e* that the player is occupying. After the placing of the wagers by each participating player the dealer deals the cards Flow 54. The dealer receives the first card 31*a*, and this card is dealt face down. Next each participating player is dealt one card 21*a* face down and the dealer is dealt a second card 31*b* and this said card is dealt face up. Of course, the order in which the cards are initially dealt may differ as desired. For example, the players may receive their face down card followed by the dealer receiving the dealer's face down card and face up card. Or, for example, the dealer may deal the dealer's face up card first, followed by the player's face down card and then the dealer's face down card. Of course, other variations in the way the cards are dealt Flow 54 are also possible and such variations are contemplated as falling within the scope of the claimed invention. Players prepare for Flow 56. At Flow 56 players inspect their card. After players examine their card the dealer queries the players that they have the decision option to surrender their one card hand by forfeiting a portion, for example one half, of their initial wager 33*a–e* and retrieving the remainder (for example one half) of the wager, or the players can refuse to surrender and proceed to Flow 58. Dealer collects the cards and partial wagers of said surrendered hands. Players prepare for Flow 58. At decision Flow 58, the remaining players are queried by the dealer that they can increase their initial wager 33*a–e* by betting an additional amount to said wager, for example by betting an equal amount (i.e., double down) and placing it next to said wager. Remaining players now come to the decision option Flow 60 wherein said players can draw additional cards 21*b–c* not to exceed two in quantity. Players can draw said quantity of cards at no additional wager cost. If player decides to not draw additional said cards 21*b–c*, then that player must place an additional wager amount, for example an amount equal to said initial wager 33*a–e*, for each of the said two cards 21*b–c* not drawn. Of course, the amount of additional wager required for each card not drawn can be an amount other than an equal amount, for example an amount equal to one half or one and a half of the initial wager, and such other or alternative amounts of additional wager are contemplated as falling within the scope of the claimed invention. Players now each have the benefit of one, two or three cards 21*a–c* comprising of the one card 21*a* each player was dealt during Flow 54 and any of the two cards 21*b–c* each player received during Flow 60. After all players have received their additional cards flow of game proceeds to Flow 62. The dealer now draws a face down third and final card 31*c* for the houses mandatory three card hand Flow 62.

Preferably the dealer receives three cards as described above. However, the predetermined amount of cards constituting a final or mandatory dealer hand may be more or less than three cards as desired, for example, by the house or dealer. Thus, a fourth card, or even a fifth or more cards may be dealt to the dealer. Such other predetermined amount of cards dealt to the dealer are contemplated as falling within the scope of the claimed invention.

Next the dealer reveals the houses two face down cards 31*a* and 31*c* to each of the remaining players Flow 64. During Flow 64, using a method unique to the present invention, the dealer calculates the summed total of the dealers hand 31*a–c* by converting or assigning each card rank of the dealers three cards 31*a–c* a non standard numerical value. For example, said values may comprise of all card ranks of Ace are given the numerical value of two, all card ranks of King, Queen or Jack are given the numerical value of one, all card ranks of Ten are given the numerical value of zero and all card ranks of Nine are given the fractional numerical value of a half card as in 0.5 (decimal point five). Of course, other numerical values may be assigned to the cards and such other values are contemplated as falling within the scope of the claimed invention. The dealers three card 31*a–c* summed score is not a competing score but is used as a median score for the players to straddle, fall next to, or land exactly on either side of with their one, two or three cards total summed score 21*a–c* if players summed score is to be considered a winning hand score. Thus, a score that is equal to the dealers score plus or minus a straddle value to either side of the dealers score is a winning players score. For example, for a straddle value of one, if the dealers three card 31*a–c* summed score equals two as in having a pair of face cards combined with a Ten card, then each player 19*a–e* would need a total summed card score 21*a–c* of one as in a pair of Nines, or one face card as in a single Jack, or said player would need a total summed card score 21*a–c* of three as in an Ace card combined with a face card, or as in an Ace card combined with two Nine cards, or as in three face cards to be considered having a winning hand. All winning scores 21*a–c* numerical value must be exactly next to on either side of the houses hands 31*a–c* median score to be considered winning scores, as in if dealers total score 31*a–c* equals three then that player 19*a–e* would need either a total card score of four or a total card score of two. Similarly, if the dealers total score 31*a–c* equals two and a half, then that players 19*a–e* total card score 21*a–c* would need to be either one and a half or three and a half in value to be a winning score. The dealer reveals the players face down cards at Flow 66 and calculates each participating players one, two or three card hands score 21*a–c* using the exact same conversion method outlined above. Finally the dealer resolves each participating players bet Flow 68 on the basis of that players 19*a–e* initial wager 33*a–e* and the numerical score of that players one, two or three card hand 21*a–c*. The dealer 30 determines what payout, if any, the player is entitled to receive according to, for example, a one for one or even money odds. Bets on non winning hands are collected by the dealer 30. All played cards are collected by the dealer 30 and the hand is then over and the flow of the game returns to Flow 52, players place bets. If the card shoe 29 is exhausted to an unplayable level, then the flow of the game returns to Flow 50, preparing and shuffling cards.

Figure 3:
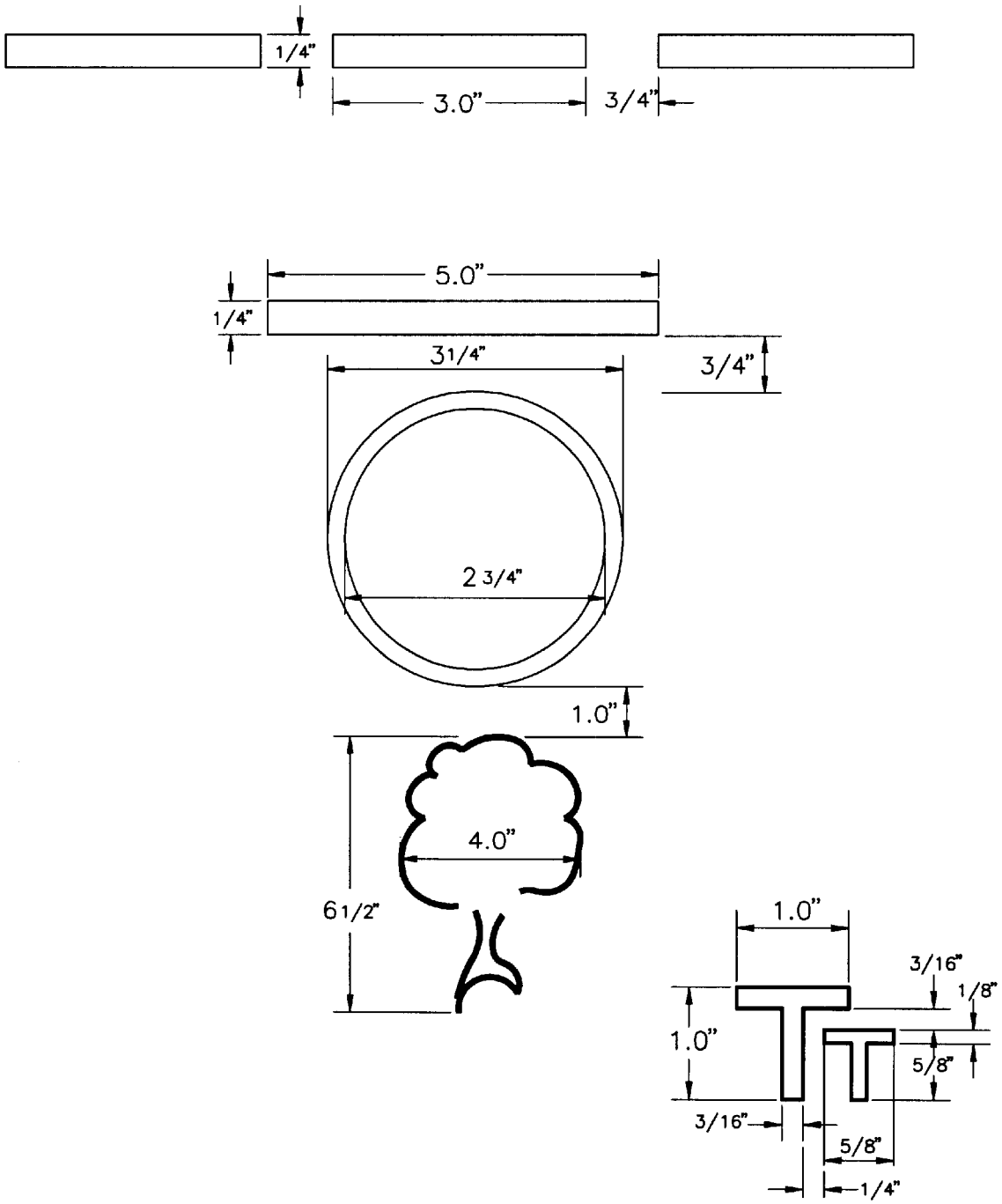
FIG. 3 depicts actual dimensions of specific areas on a gaming table top in accordance with the present invention.

Referring to FIG. 3, this is a diagram wherein the table top positions for the players positions and wager areas, said card areas, a dealer or house card area and the author of the present inventions abbreviated company name; "TABLE-TOP TECHNOLOGY" (TT) are depicted in a two-dimensional view.

Figure 4:
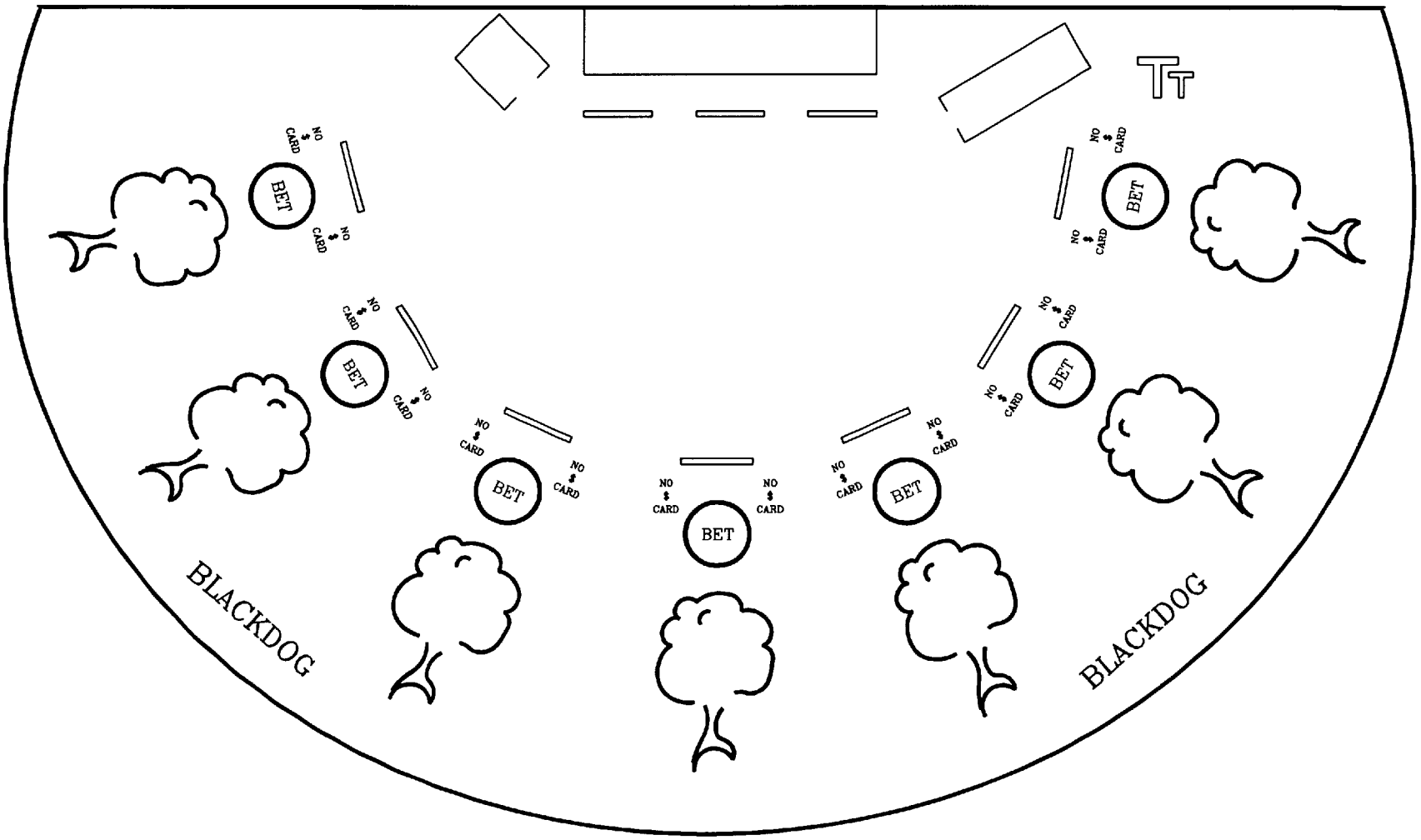
FIG. 4 depicts a table top layout and apparatus used in playing a wagering game in accordance with another embodiment of the present invention wherein cards are not shown.
Figure 5:
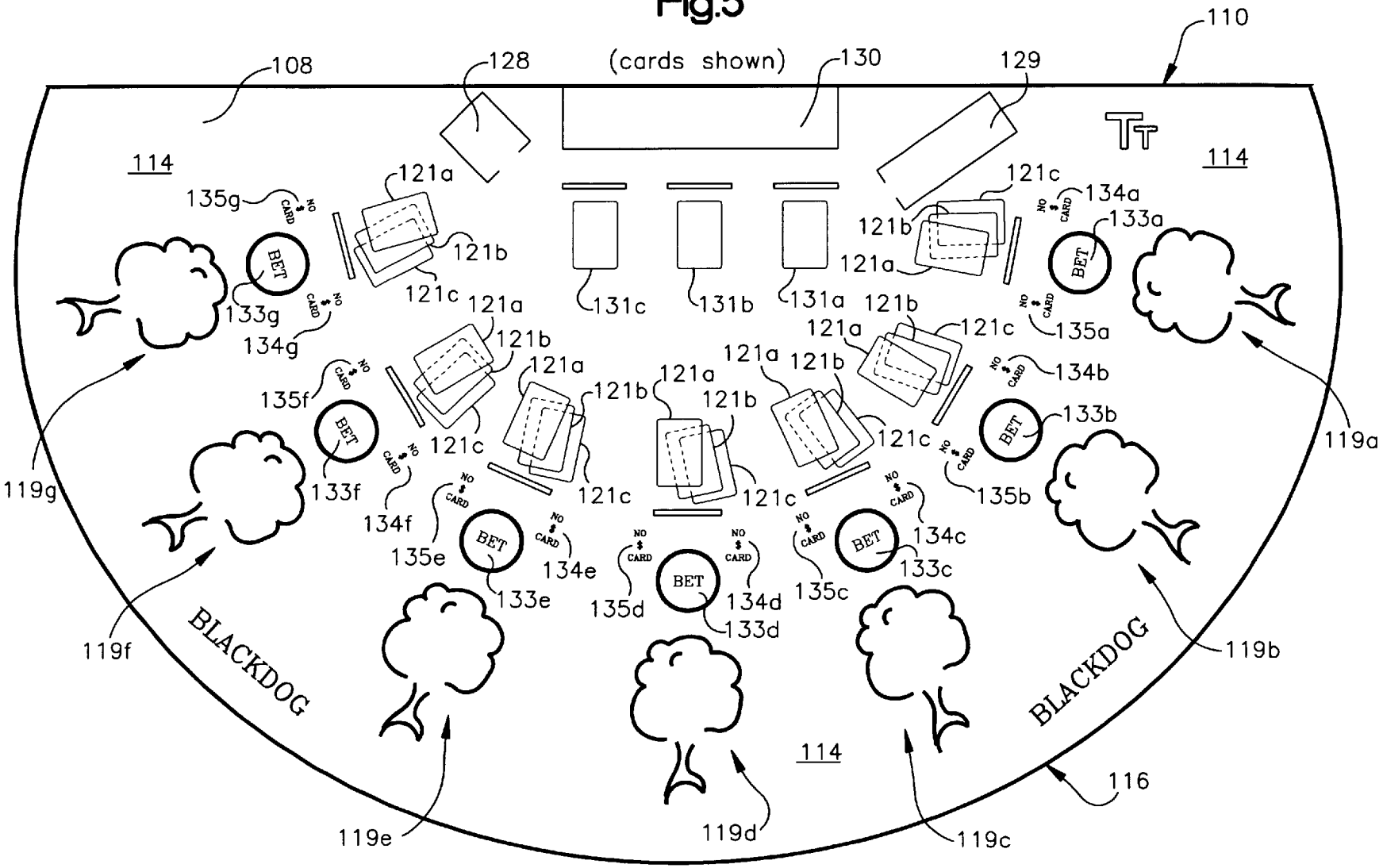
FIG. 5 depicts the table layout and apparatus used in playing the wagering game depicted in FIG. 4 wherein cards are shown.

Referring now to FIGS. 4 and 5, an apparatus for the wagering game of the present invention includes a typical casino gaming, half sphere in geometric shape table 108. FIG. 4 shows the table wherein cards are not shown and FIG. 5 shows the table wherein cards are shown. The table 108 has a curved side 116 for accommodating up to seven players and a straight side 110 for accommodating the dealer. The table 108 has a flat surface 114 covered with cloth, felt or other appropriate material. Although seven player positions or locations 119*a–e* (each being depicted by a single tree) are provided it is not essential to the game that exactly seven persons play and as many as fourteen players may participate. For professional or casino play a maximum of seven players provides for a game that is easily manageable by the dealer. A house dealer position 130 including an area suitable for receiving and displaying the dealers or houses cards 131*a–c* is also provided. Each of the player positions 119*a–g* includes three wagering areas 133*a–g*, 134*a–g*, 135-*g*, respectively. Each player position 119*a–g* also includes a card area for receiving one, two or three cards 121*a–c* dealt to the player occupying that position. The wagering areas 133*a–g*, 134*a–g*, 135*a–g* are designed to receive appropriate wagering settling means such as coins or chips (not shown). At one side of the dealer position 130 the apparatus for containing the conglomeration of hand shuffled cards rests unmounted on the table top 114 and is commonly referred to as a card shoe 129. The card shoe 129 is loaded or filled with said cards by the dealer. Said apparatus is of a typical open ended box for dispensing cards face down. At one side of the dealer position 130 is an apparatus for receiving and accumulating the used cards during game play and said may be of a raised three wall type open ended plastic box 128. Said apparatus' 108, 128 and 129 are provided by the house or casino.

Figure 6:
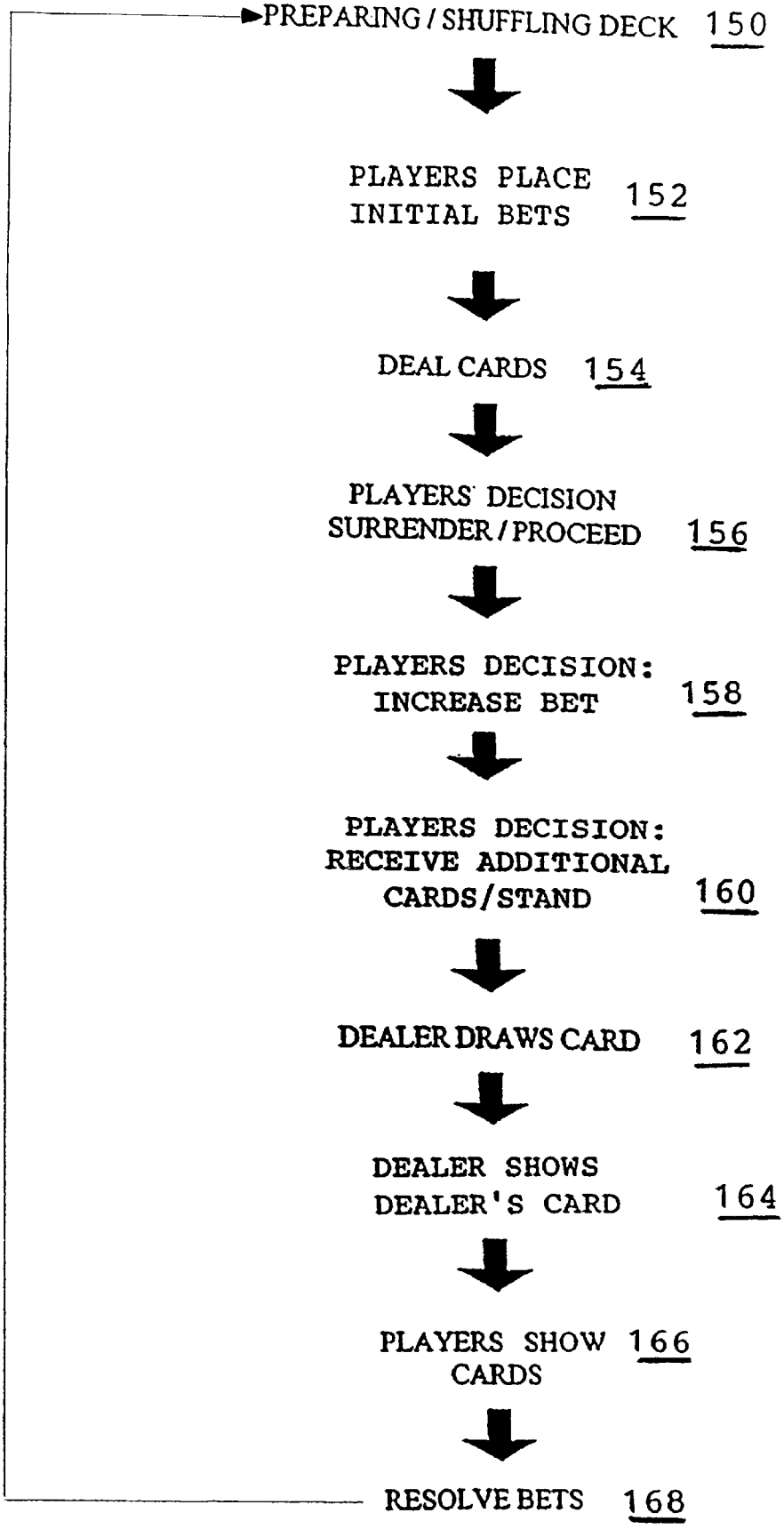
FIG. 6 is a Flow diagram representing the flow of play in said FIG. 4 game.

Referring to the Flow diagram of FIG. 6, the first step in playing the game of the present invention is preparing and shuffling the higher ranking cards or portion of a deck of Poker playing cards Flow 150. Said shuffling is done by hand and is done by the dealer. Next the participating players place their initial wager Flow 152 by placing an amount or chips into the wagering areas 133*a–g* in front of that player position 119*a–g* that the player is occupying. After the placing of the wagers by each participating player the dealer deals the cards Flow 154. The dealer receives the first card 131*a*, and this card is dealt face down. Next each participating player is dealt one card 121*a* face down and the dealer is dealt a second card 131*b* and this said card is dealt face up. Of course, the order in which the cards are initially dealt may differ as desired. For example, the players may receive their face down card followed by the dealer receiving the dealer's face down card and face up card. Or, for example, the dealer may deal the dealer's face up card first, followed by the player's face down card and then the dealer's face down card. Of course, other variations in the way the cards are dealt Flow 154 are also possible and such variations are contemplated as falling within the scope of the claimed invention. Players prepare for Flow 156. At Flow 156 players inspect their card. After players examine their card the dealer queries the players that they have the decision option to surrender their one card hand by forfeiting a portion, for example one half, of their initial wager 133*a–g* and retrieving the remainder (for example one half) of the wager, or the players can refuse to surrender and proceed to Flow 158. Dealer collects the cards and partial wagers of said surrendered hands. Players prepare for Flow 158. At decision Flow 158, the remaining players are queried by the dealer that they can increase their initial wager 133*a–g* by betting an additional amount to said wager, for example by betting an equal amount (i.e., double down) and placing it into said wager area 134*a–g* and/or 135*a–g*. Remaining players now come to the decision option Flow 160 wherein said players can draw additional cards 121*b–c* not to exceed two in quantity. Players can draw said quantity of cards at no additional wager cost. If player decides to not draw additional said cards 121*b–c*, then that player must place an additional wager amount, for example an amount equal to said initial wager 133*a–g*, into 134*a–g* and/or 135*a–g* for each of the said two cards 121*b–c* not drawn. Of course, the amount of additional wager required for each card not drawn can be an amount other than an equal amount, for example an amount equal to one half or one and a half of the initial wager, and such other or alternative amounts of additional wager are contemplated as falling within the scope of the claimed invention. Players now each have the benefit of one, two or three cards 121*a–c* comprising of the one card 121*a* each player was dealt during Flow 154 and any of the two cards 121*b–c* each player received during Flow 160. After all players have received their additional cards flow of game proceeds to Flow 162. The dealer now draws a face down third and final card 131*c* for the houses mandatory three card hand Flow 162.

Preferably the dealer receives three cards as described above. However, the predetermined amount of cards constituting a final or mandatory dealer hand may be more or less than three cards as desired, for example, by the house or dealer. Thus, a fourth card, or even a fifth or more cards may be dealt to the dealer. Such other predetermined amount of cards dealt to the dealer are contemplated as falling within the scope of the claimed invention.

Next the dealer reveals the houses two face down cards 131*a* and 131*c* to each of the remaining players Flow 164. During Flow 164, using a method unique to the present invention, the dealer calculates the summed total of the dealers hand 131*a–c* by converting or assigning each card rank of the dealers three cards 131*a–c* a non standard numerical value. For example, said values may comprise of all card ranks of Ace are given the numerical value of two, all card ranks of King, Queen or Jack are given the numerical value of one, all card ranks of Ten are given the numerical value of zero and all card ranks of Nine are given the fractional numerical value of a half card as in 0.5 (decimal point five). Of course, other numerical values may be assigned to the cards and such other values are contemplated as falling within the scope of the claimed invention. The dealers three card 131*a–c* summed score is not a competing score but is used as a median score for the players to straddle, fall next to, or land exactly on either side of with their one, two or three cards total summed score 121*a–c* if players summed score is to be considered a winning hand score. Thus, a score that is equal to the dealers score plus or minus a straddle value to either side of the dealers score is a winning players score. For example, for a straddle value of one, if the dealers three card 131*a–c* summed score equals two as in having a pair of face cards combined with a Ten card, then each player 119*a–g* would need a total summed card score 121*a–c* of one as in a pair of Nines, or one face card as in a single Jack, or said player would need a total summed card score 121*a–c* of three as in an Ace card combined with a face card, or as in an Ace card combined with two Nine cards, or as in three face cards to be considered having a winning hand. All winning scores

121*a–c* numerical value must be exactly next to on either side of the houses hands 131*a–c* median score to be considered winning scores, as in if dealers total score 131*a–c* equals three then that player 119*a–g* would need either a total card score of four or a total card score of two. Similarly, if the dealers total score 131*a–c* equals two and a half, then that players 119*a–e* total card score 121*a–c* would need to be either one and a half or three and a half in value to be a winning score. The dealer reveals the players face down cards at Flow 166 and calculates each participating players one, two or three card hands score 121*a–c* using the exact same conversion method outlined above. Finally the dealer resolves each participating players bet Flow 168 on the basis of that players 119*a–g* wagers 133*a–g*, 134*a–g*, 135*a–g* and the numerical score of that players one, two or three card hand 121*a–c*. The dealer 130 determines what payout, if any, the player is entitled to receive according to, for example, a one for one or even money odds. Bets on non winning hands are collected by the dealer 130. All played cards are collected by the dealer 130 and the hand is then over and the flow of the game returns to Flow 152, players place bets. If the card shoe 129 is exhausted to an unplayable level, then the flow of the game returns to Flow 150, preparing and shuffling cards.

Figure 7:
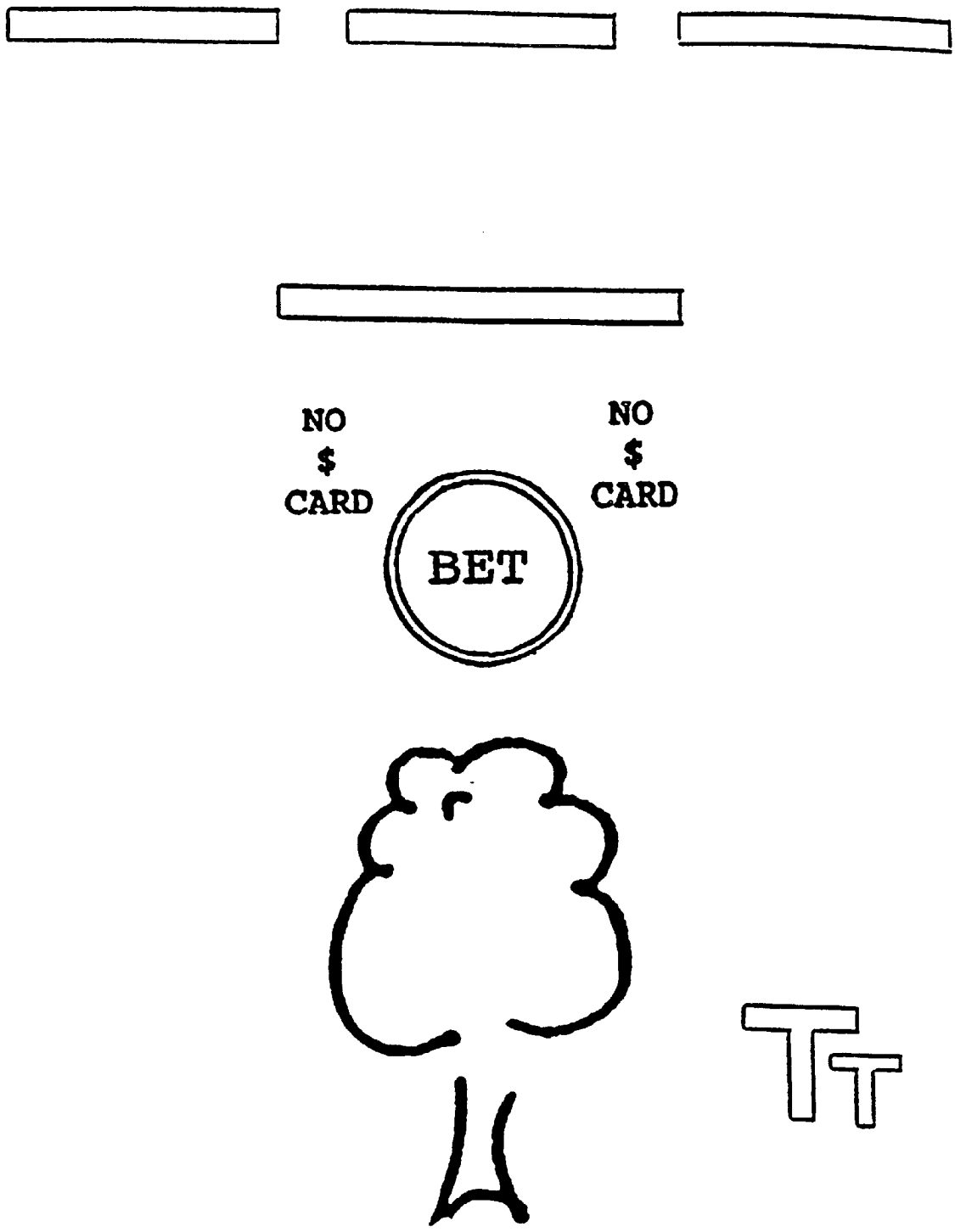
FIG. 7 depicts actual dimensions of specific areas on a gaming table top in accordance with the present invention and for use in said FIG. 4 game.

Referring to FIG. 7, this is a diagram wherein the table top positions for the players positions and wager areas, said card areas, a dealer or house card area and the author of the present inventions abbreviated company name; "TABLE-TOP TECHNOLOGY" (TT) are depicted in a two-dimensional view.

The wagering game of the present invention might be played live in casinos with a house dealer or homes in interactive electronic or video form with automatic coin or betting machines with payout capabilities. The present invention may also be embodied in other specific forms without departing from the essential attributes thereof. It is desired that the embodiments described above may be considered in all respects as illustrative and not restrictive, reference being made to the appended claims.

What is claimed is:

1. A method of playing a wagering game for a number of players using the higher ranking portion of a typical fifty-two card Poker playing deck, or using a typical Pinochle playing card deck, wherein each rank of the playing cards is assigned a numerical value, the method comprising the steps of:

dealing one card face down to each player;

dealing one card face down to a dealer;

dealing one card face up to the dealer;

giving each player the opportunity to inspect their one card;

each player placing a wager;

giving each player the option to be dealt an additional card;

dealing a third card to the dealer;

showing each player the dealers cards face up;

revealing the players cards;

calculating each player's score based on the assigned numerical values of the player's revealed cards;

calculating a dealer's score based on the assigned numerical values of the dealer's cards; and resolving each players wager based on whether the player's score is either above or below the dealer's score by a predetermined straddle value.

2. The method according to claim 1, further including giving a player that has chosen to be dealt an additional card the option to be dealt a second additional card.

3. The method according to claim 1, wherein the score associated with the respective players cards comprises a sum of the numerical values of that players cards, the numerical values being based on the numerical values pre-assigned to the respective ranks of the cards.

4. The method according to claim 1, wherein the score associated with the dealers cards comprises a sum of the numerical values of the dealers cards, the numerical values being based on the numerical values pre-assigned to the respective ranks of the cards.

5. The method according to claim 1, further including, before dealing one card face down to each player, each player placing an initial wager to participate in the game.

6. The method according to claim 5, further including, after giving each player the option to inspect their one card, giving each player the option to surrender or to continue play.

7. The method according to claim 6, wherein if a player chooses to surrender play the player must forfeit a portion of the players initial wager.

8. The method according to claim 5, wherein if a player chooses to not be dealt an additional card, the player must add an additional amount of wager to the initial wager.

9. A method of playing a wagering game for a number of players, comprising the steps of:

providing a plurality of playing cards, wherein at least two of the cards have a different rank, each rank of the playing cards being assigned a value;

each player placing a wager;

dealing one card to each player;

dealing one card face up to a dealer;

dealing one card face down to the dealer;

giving each player the option to inspect their one card;

giving each player the option to be dealt one or more additional cards up to a predetermined amount of player cards;

dealing one or more additional cards to the dealer up to a predetermined amount of dealer cards;

revealing to each player the dealers cards;

revealing the players cards;

calculating each player's score based on the assigned numerical values of the player's revealed cards;

calculating a dealer's score based on the assigned numerical values of the dealer's cards; and resolving each players wager based on whether the player's score is either above or below the dealer's score by a predetermined amount.

10. The method according to claim 9, wherein after the step of giving each player the option to inspect their one card, giving each player the option to either surrender or to continue play.

11. The method according to claim 10, wherein if a player chooses to surrender play the player must forfeit a portion of the players wager.

12. The method according to claim 9, wherein after the step of giving each player the option to inspect their one card, giving each player the option to increase their wager.

13. he method according to claim 9, wherein if a player chooses not to be dealt one or more additional cards, the player must increase that players wager.

14. The method according to claim 13, wherein the players increased wager corresponds to the number of cards the player refuses to be dealt up to the predetermined amount of player cards.

15. The method according to claim 14, wherein the predetermined amount of player cards is three.

16. The method according to claim 9, wherein the predetermined amount of dealer cards is three.

17. The method according to claim 9, wherein the step of providing a plurality of differently ranked playing cards comprises providing a standard Pinochle playing deck or portion comprising the card ranks of Nine through Ace of a typical fifty-two card Poker deck.

18. The method according to claim 9, wherein the score associated with the respective players cards comprises a sum of the numerical values of that players cards, the numerical values being based on the numerical values pre-assigned to the respective ranks of the cards.

19. The method according to claim 9, wherein the score associated with the dealers cards comprises a sum of numerical values of the dealers cards, the numerical values being based on the numerical values pre-assigned to the respective ranks of the cards.

20. A method of playing a wagering card game for a number of players using the portion comprising the card ranks of Nine through Ace of a typical fifty-two card Poker deck, or using a typical Pinochle playing card deck, wherein each rank of the playing cards is assigned a numerical value, the method comprising the steps of:

each player placing an initial wager to participate in the game;

dealing one card face down to each player;

dealing one card face down to a dealer;

dealing one card face up to the dealer;

giving each player the opportunity to examine their one card received and the option to withdraw from play and forfeit a part of their initial wager or to continue play;

giving each player the option to stand or increase their initial wager;

giving each player the option to potentially build on an initial score associated with their said one card by receiving an additional card, the player placing an additional wager if the player decides not to receive an additional card;

dealing a third card to the dealer;

showing each player the dealers cards face up;

revealing each players cards;

calculating each player's score based on the assigned numerical values of the player's revealed cards;

calculating a dealer's score based on the assigned numerical values of the dealer's cards; and resolving each player's wager based on whether the players score is either above or below the dealer's score by a predetermined straddle value.

21. The method according to claim 20, wherein if a player chooses to increase their initial wager instead of standing then the player must double their initial wager.

22. The method according to claim 20, wherein each player can keep their one card by placing a wager equal to said initial wager for each additional card not dealt up to two.

23. The method according to claim 20, wherein each player can draw two additional cards at no additional wager cost.

24. A method of playing a wagering card game for a number of players using a standard Pinochle playing deck or the portion comprising the card ranks of Nine through Ace of a typical fifty-two card Poker deck, wherein each rank of the playing cards is assigned a numerical value, the method comprising the steps of:

each player placing an initial one part wager to participate in the game;

dealing one card face down to each player;

dealing one card face down to a dealer;

dealing one card face up to the dealer;

giving each player the opportunity to examine their one card and giving each player the option to surrender their one card hand by forfeiting a portion of their initial wager and keeping the remainder of their initial wager;

giving each player, that does not opt to surrender, the option to increase their initial wager by adding an additional amount to said initial wager;

giving each player the option to receive up to two additional cards or to not receive one or two additional cards, in which case such player places a wager amount in addition to said initial wager for each of the one or two cards the player opted not to receive;

dealing a third card to the dealer;

showing each player the dealers cards;

calculating each player's score based on the assigned numerical values of the player's revealed cards;

calculating the dealer's score based on the assigned numerical values of the dealer's cards; and resolving each player's wager based on whether the player's score is equivalent to the dealers score plus or minus a pre-assigned straddle value.

25. The method according to claim 24, wherein all card ranks of Ace have a pre-assigned numerical value of two, all card ranks of King, Queen and Jack have a pre-assigned numerical value of one, all card ranks of Ten have a pre-assigned numerical value of zero and all card ranks of Nine have a pre-assigned fractional numerical value of 0.5 (decimal point five).

26. An apparatus for playing the wagering game of claim 24, said apparatus including a playing surface having a card receiving area for receiving and displaying the players cards wherein each receiving area is depicted by a single tree player position, a wager receiving area for receiving that players wager, and a dealer card receiving area for receiving and displaying the dealers three card hand.

27. An apparatus for playing the wagering game of claim 24, said apparatus including a playing surface having a card receiving area for receiving and displaying the players cards wherein each receiving area is depicted by a single tree player position, three wager receiving areas for receiving that players wager, and a dealer card receiving area for receiving and displaying the dealers three card hand.

28. A method of playing a wager card game for a number of players using a standard Pinochle playing deck or portion comprising the card ranks of Nine through Ace of a typical fifty-two card Poker deck, the method comprising the steps of:

each player placing an initial one part wager to participate in the game;

dealing one card face down to each player and one card face down and one card face up to a dealer;

giving each player the opportunity to examine their one card and giving each player the option to surrender their hand by forfeiting a portion of their initial wager and keeping the remainder of their initial wager;

giving each player the option to increase their initial wager by adding an additional amount to said initial wager;

giving each player the option to increase an initial score associated with their one card by receiving one or two additional cards or to keep their initial score by placing a wager amount in addition to said initial wager for each of the one or two cards not drawn;

dealing a third card to the dealer;

showing each player the dealers cards;

calculating a total score associated with the dealers cards and a total score associated with each players one, two or three cards, wherein the total score is based on a sum of numerical values pre-assigned to the respective ranks of the cards;

determining which players have a total score equivalent to the dealers total score plus or minus a pre-assigned straddle value, wherein said pre-assigned straddle value has a numerical value of one.

29. The method according to claim 28, wherein card ranks of Ace have a pre-assigned numerical value of two.

30. The method according to claim 28, wherein card ranks of King, Queen and Jack have a pre-assigned numerical value of one.

31. The method according to claim 28, wherein card ranks of Ten have a pre-assigned numerical value of zero.

32. A method of playing a wager card game for a number of players using a standard Pinochle playing deck or portion comprising the card ranks of Nine through Ace of a typical fifty-two card Poker deck, the method comprising the steps of:

each player placing an initial one part wager to participate in the game;

dealing one card face down to each player and one card face down and one card face up to a dealer;

giving each player the opportunity to examine their one card and giving each player the option to surrender their hand by forfeiting a portion of their initial wager and keeping the remainder of their initial wager;

giving each player the option to increase their initial wager by adding an additional amount to said initial wager;

giving each player the option to increase an initial score associated with their one card by receiving one or two additional cards or to keep their initial score by placing a wager amount in addition to said initial wager for each of the one or two cards not drawn;

dealing a third card to the dealer;

showing each player the dealers cards;

calculating a total score associated with the dealers cards and a total score associated with each players one, two or three cards, wherein the total score is based on a sum of numerical values pre-assigned to the respective ranks of the cards;

determining which players have a total score equivalent to the dealers total score plus or minus a pre-assigned straddle value, wherein card ranks of Nine have a pre-assigned fractional numerical value of 0.5.

33. The method according to claim 32, wherein said pre-assigned straddle value has a numerical value of one and a half.

34. The method according to claim 32, wherein said pre-assigned straddle value has more than one numerical value.

35. The method according to claim 32, wherein said pre-assigned straddle value has a numerical value of one or one and a half.

36. A method of playing a wager card game for a number of players using a standard Pinochle playing deck or portion comprising the card ranks of Nine through Ace of a typical fifty-two card Poker deck, the method comprising the steps of:

each player placing an initial one part wager to participate in the game;

dealing one card face down to each player and one card face down and one card face up to a dealer;

giving each player the opportunity to examine their one card and giving each player the option to surrender their hand by forfeiting a portion of their initial wager and keeping the remainder of their initial wager;

giving each player the option to increase their initial wager by adding an additional amount to said initial wager;

giving each player the option to increase an initial score associated with their one card by receiving one or two additional cards or to keep their initial score by placing a wager amount in addition to said initial wager for each of the one or two cards not drawn;

dealing a third card to the dealer;

showing each player the dealers cards;

calculating a total score associated with the dealers cards and a total score associated with each players one, two or three cards, wherein the total score is based on a sum of numerical values pre-assigned to the respective ranks of the cards;

determining which players have a total score equivalent to the dealers total score plus or minus a pre-assigned straddle value, wherein a players total score may be either greater than or less than in value than the dealers three card total score.

37. The method according to claim 36, wherein the players total score must have a value next to by one whole or one whole and a half value on either side of the dealers total score to be a winning hand for that player.

* * * * *